US009593902B2

(12) United States Patent
Barnes

(10) Patent No.: US 9,593,902 B2
(45) Date of Patent: Mar. 14, 2017

(54) SYSTEMS AND METHODS ASSOCIATED WITH A FIREARM SLEEVE

(71) Applicant: William B. Barnes, Cedar Park, TX (US)

(72) Inventor: William B. Barnes, Cedar Park, TX (US)

(73) Assignee: AR Customs, Cedar Park, TX (US)

( * ) Notice: Subject to any disclaimer, the term of this patent is extended or adjusted under 35 U.S.C. 154(b) by 0 days.

(21) Appl. No.: 14/636,015

(22) Filed: Mar. 2, 2015

(65) Prior Publication Data

US 2016/0010947 A1 Jan. 14, 2016

Related U.S. Application Data

(60) Provisional application No. 61/946,992, filed on Mar. 3, 2014.

(51) Int. Cl.

| | |
|---|---|
| ***F41C 23/16*** | (2006.01) |
| ***F41H 3/00*** | (2006.01) |
| ***F41A 35/02*** | (2006.01) |
| *F41A 9/61* | (2006.01) |

(52) U.S. Cl.

CPC ..... *F41A 35/02* (2013.01); *F41C 23/16* (2013.01); *F41H 3/00* (2013.01); *F41A 9/61* (2013.01)

(58) Field of Classification Search

CPC ..... F41C 27/00; F41C 33/0281; F41C 23/16; F41A 9/34; F41A 9/61; F41A 9/65; F41H 3/00

USPC ..... 42/90, 106, 49.01, 49.02, 50

See application file for complete search history.

(56) References Cited

U.S. PATENT DOCUMENTS

| | | | | | |
|---|---|---|---|---|---|
| 5,711,720 | A * | 1/1998 | Janes | A63B 49/08 | 473/300 |
| 5,730,669 | A * | 3/1998 | Huang | A63B 49/08 | 473/302 |
| 6,138,292 | A * | 10/2000 | O'Toole | G09F 23/00 | 4/246.1 |
| 6,212,815 | B1 * | 4/2001 | Fitzpatrick | F41A 9/65 | 224/196 |
| 6,314,598 | B1 * | 11/2001 | Yates | A47C 7/18 | 156/84 |
| 6,342,031 | B1 * | 1/2002 | Vaughan | A63B 21/0084 | 434/254 |
| 6,685,583 | B2 * | 2/2004 | Severa | A63B 49/08 | 473/523 |
| 6,718,675 | B1 * | 4/2004 | Lu | G09F 3/18 | 40/317 |
| 6,986,221 | B2 * | 1/2006 | Mullis | F41A 23/02 | 42/74 |
| 7,377,859 | B2 * | 5/2008 | Reardon | A63B 53/14 | 473/300 |
| 7,461,474 | B1 * | 12/2008 | Lu | G09F 3/20 | 40/660 |
| 8,099,894 | B1 * | 1/2012 | Philbin | F41A 9/65 | 224/196 |
| 8,793,914 | B2 * | 8/2014 | Anderson | F41A 9/65 | 42/49.01 |

(Continued)

*Primary Examiner* — Jonathan C Weber
(74) *Attorney, Agent, or Firm* — Pierson IP, PLLC

(57) ABSTRACT

Embodiments described herein are directed towards a sleeve. The sleeve may be configured to cover a detachable magazine, such as a detachable magazine for an assault rifle. In embodiments, the sleeve may be comprised of waterproof and/or weatherproof materials.

6 Claims, 4 Drawing Sheets

(56) References Cited

U.S. PATENT DOCUMENTS

| | | | | | |
|---|---|---|---|---|---|
| D739,490 | S * | 9/2015 | Iannello | F41A 9/65 | D22/108 |
| 2002/0098904 | A1* | 7/2002 | Huang | A63B 53/14 | 473/300 |
| 2003/0114782 | A1* | 6/2003 | Chiang | A61F 5/01 | 602/6 |
| 2006/0006634 | A1* | 1/2006 | Packer | A63C 11/027 | 280/809 |
| 2008/0102974 | A1* | 5/2008 | Nam | A63B 53/14 | 473/300 |
| 2009/0082128 | A1* | 3/2009 | Nam | A63B 53/14 | 473/300 |
| 2011/0023347 | A1* | 2/2011 | Boggan | F41A 35/02 | 42/96 |
| 2011/0167698 | A1* | 7/2011 | Hoguc | F41C 23/10 | 42/71.02 |
| 2012/0174452 | A1* | 7/2012 | Anderson | F41A 9/65 | 42/49.01 |

* cited by examiner

SYSTEMS AND METHODS ASSOCIATED WITH A FIREARM SLEEVE

CROSS-REFERENCE TO RELATED APPLICATIONS

This application claims a benefit of priority under 35 U.S.C. §119 to Provisional Application No. 61/946,992 filed on Mar. 3, 2014, which is fully incorporated herein by reference in their entirety.

BACKGROUND INFORMATION

Field of the Disclosure

Examples of the present disclosure relate to techniques associated with sleeves. More particularly, embodiments are related to a removable sleeve that is configured to cover a portion of a sleeve.

Background

A magazine is an ammunition storage and feeding device within or attached to a repeating firearm. Magazines can be removable or integral to the firearm. A magazine functions by moving the cartridges stored in the magazine into a position where projectiles can be loaded into the chamber by the action of the firearm. Magazines come in many different shapes and sizes, which may be based on the type of firearm.

Conventionally, magazines are made of metal or plastic, which may be hard to grip when inserting and/or removing the magazine from the firearm.

Additionally, a magazine may increase in temperature when the projectiles stored into the magazine are loaded into the chamber of the firearm. Due to the lack of grip or the temperature of a magazine, the magazine may be difficult for a user to grip.

Accordingly, needs exists for more efficient and effective systems and methods for a sleeve configured to allow a user to more easily hold a magazine and move the magazine.

SUMMARY

Embodiments described herein are directed towards a sleeve. The sleeve may be configured to cover a detachable magazine, such as a magazine for an assault rifle. In embodiments, the sleeve may be comprised of waterproof and/or weatherproof materials.

In embodiments, the sleeve may be configured to slide over the detachable magazine. Responsive to sliding the sleeve over the magazine, the sleeve may encase the sidewalls of the magazine that is not housed within the firearm. Additionally, in embodiments, when the sleeve is slid over the magazine, a bottom surface of the magazine may not be covered by the sleeve.

In embodiments, the sleeve may be comprised of a synthetic rubber, wherein the thickness of the rubber may be between one millimeter and two and a half millimeters. The sleeve may include multiple layers comprised of different materials.

In embodiments, the sleeve may have a coefficient of friction that is greater than the material of the magazine, and also be comprised of a material that is more malleable than the magazine. Therefore, it may be easier for a user to grip the sleeve than the magazine. Additionally, the coefficient of friction between an internal surface of the sleeve and the magazine may be configured to couple the sleeve and the magazine. Accordingly, when a user grabs the sleeve positioned on the magazine to remove the magazine from the firearm or to reinsert the magazine into the firearm, the sleeve may remain in place around the magazine.

In embodiments, the sleeve may be customized with different logos, pictures, decals, etc. The customization of the sleeve may be creating by dye-sublimation printing. During the printing process, heat may be utilized to transfer dye onto an external surface of the sleeve. Alternatively, another semi-permanent or permanent printing method may be utilized to customize a sleeve.

In embodiments, rubber on the external surface of the sleeve may be a different rubber than the internal surface of the sleeve. Accordingly, the coefficient of friction of the internal surface of the sleeve may be different than the coefficient of friction of the external surface of the sleeve.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
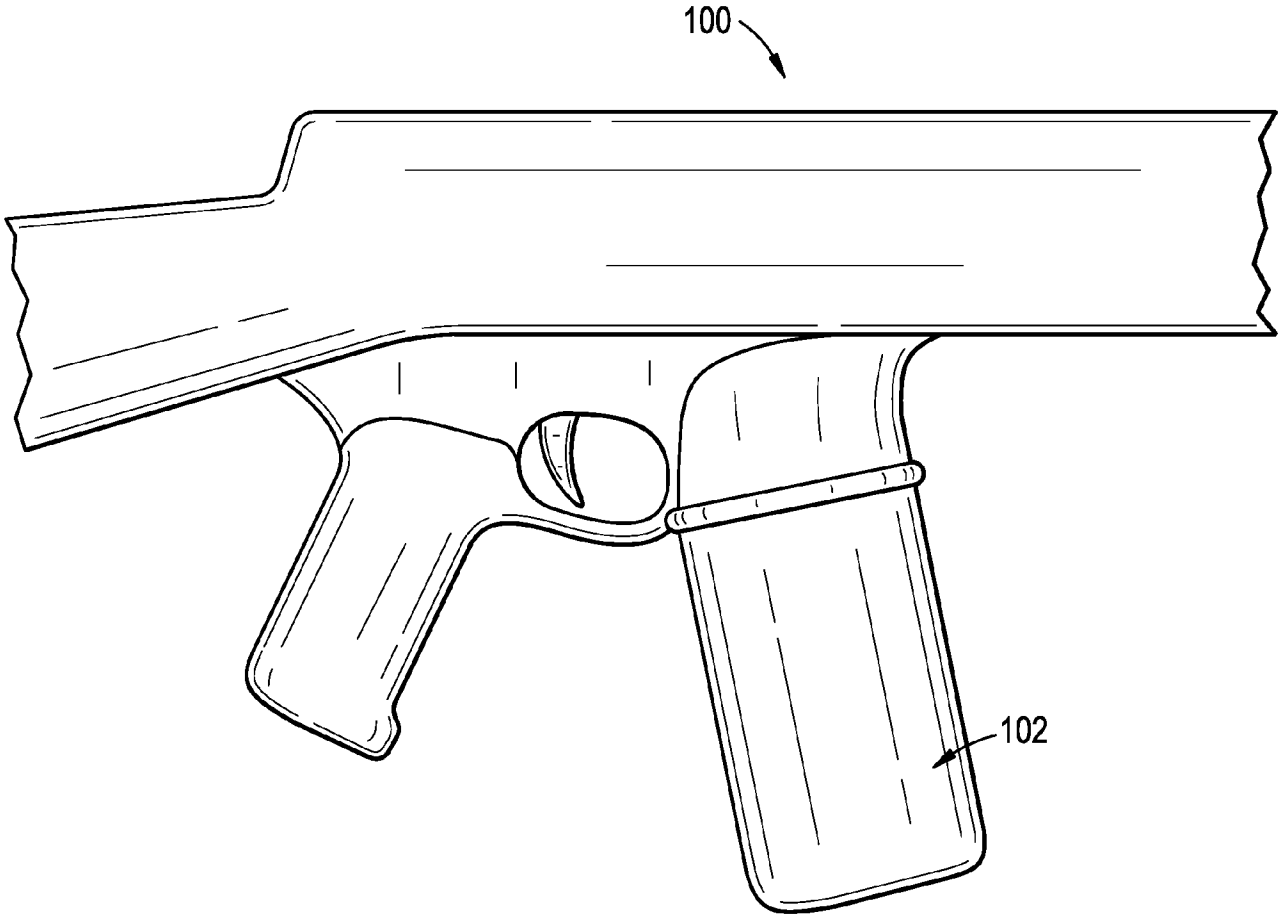
FIG. 1 depicts a side view of a firearm, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments described herein are directed towards a sleeve. The sleeve may be configured to cover a detachable magazine, such as a detachable magazine for an assault rifle.

Embodiments may be utilized by a user of a firearm to hold and operate a firearm more easily.

FIG. 1 depicts an embodiment of a firearm 100. Firearm 100 may be any type of portable gun that is configured to launch one or more rounds, cartridges, projectiles, etc. via an explosive force. Firearm 100 may be configured to receive projections via magazine 102.

Magazine 102 may be an ammunition storage and feeding device that is configured to couple and decouple from firearm 100. Magazine 102 may be configured to move rounds stored in magazine 102 into a position to be loaded into the chamber of firearm 100. During action of firearm 100, the rounds may be moved from magazine 102 into the firearm's chamber in preparation for firing. Different magazines 102 may have different shapes and/sizes, wherein different magazines 102 may be configured to hold different types and numbers of projectiles.

In embodiments, the outermost structure of magazine 102 may be in the form of a rectangular-shaped box, wherein magazine 102 may be comprised of various rigid materials, such as plastics, metals, etc. When magazine 102 is coupled with firearm 100, a first portion of magazine 102 may be configured to be housed within firearm 100, and a second portion of magazine 102 may be configured to extend away from a body of firearm 100.

Conventionally, magazines 102 may have rough or sharp edges, making magazine 102 uncomfortable for a user to couple and decouple magazine 102 from firearm 100. Furthermore, variations in the weather may affect the temperature or slickness of the magazine (e.g. hot, cold, wet, etc.), which may again create issued for the user when attempting to couple and decouple magazine 102 from firearm 100.

Figure 2:
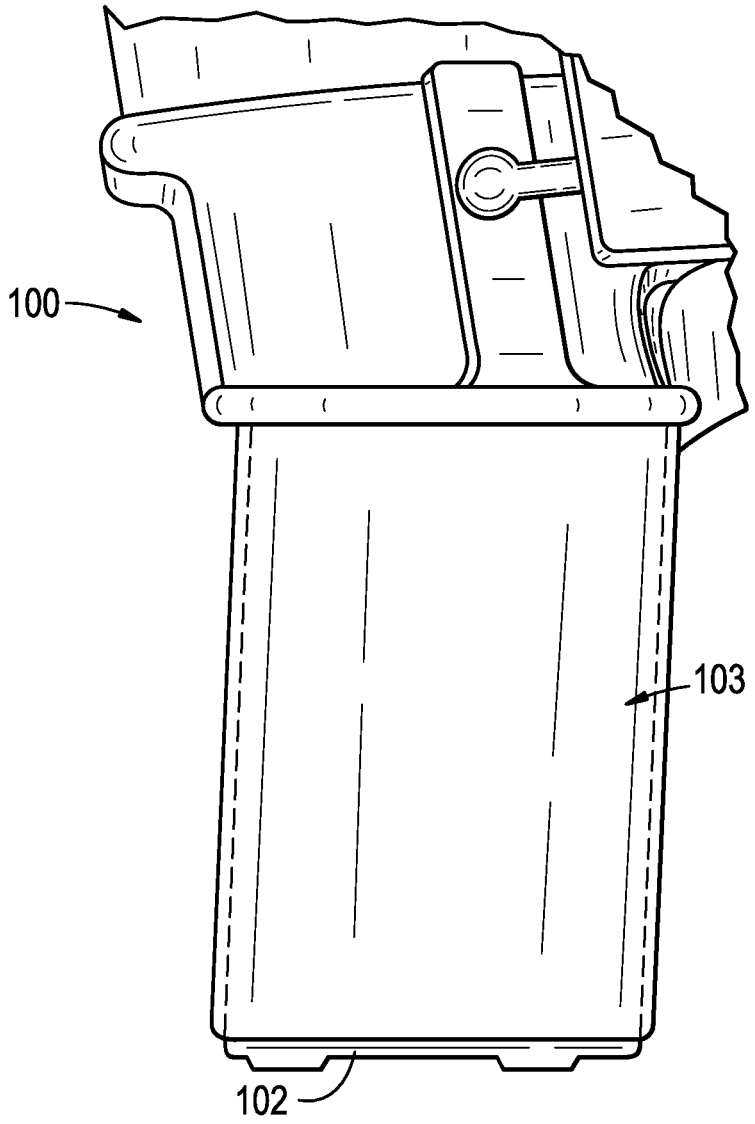
FIG. 2 depicts a side view of a sleeve being positioned on a firearm, according to an embodiment.

Turning now to FIG. 2, FIG. 2 depicts one embodiment of a sleeve 103 that is configured to cover at least a portion of magazine 102.

Sleeve 103 may be comprised of a synthetic rubber, wherein the thickness of the rubber may vary between one millimeter and two and a half millimeters in thickness. For example, sleeve 103 may have a thickness of one and half millimeters.

Sleeve 103 may have a first opening at the top of sleeve 103, and a second opening at the bottom of sleeve 103. However, in other embodiments, sleeve 103 may have a closed bottom. Regardless of whether sleeve 103 includes an open or closed bottom, the first opening positioned at the top of sleeve 103 may be configured to enable sleeve 103 to slide over magazine 102. Sleeve 103 may be configured to be positioned on magazine 102 when magazine 102 is coupled to firearm 100, or when magazine 102 is decoupled from firearm 100. A user may place sleeve 103 on magazine by aligning the top opening of sleeve 103 with a base of magazine 102, and using force to pull sleeve 103 into place around magazine 102.

As depicted in FIG. 2, sleeve 103 may be positioned around magazine 102, such that the sidewalls of the second portion of magazine 102 coupled with firearm 100 are covered by sleeve 102. Responsive to positioning sleeve 103 around magazine 102, the shape of sleeve 103 may conform to be substantially the same shape and size as magazine 102. Therefore, when sleeve 103 is positioned over magazine 102, the internal surface of sleeve 103 may be positioned adjacent to the second portion of magazine 102.

Sleeve 103 may be configured to closely confirm to the shape of magazine 103, and thus fit tightly around magazine 100. The coefficient of friction between an internal surface of sleeve 103 and magazine 102 may aid to hold sleeve 102 in place. Accordingly, when a user grabs sleeve 103 covered magazine 102 to couple or decouple magazine 102 from firearm 100, sleeve 103 may remain in place around the magazine 102.

Furthermore, sleeve 103 may be comprised of at least three different layers. A first layer may be positioned on an internal surface of sleeve 103, a second layer may be positioned between the first and the third layer, and the third lawyer may be positioned on an external surface of sleeve 103.

The first layer may be comprised of a first rubber material, such as a natural rubber. The first layer may be configured to maintain flexibility over a wide temperature range. The first layer of sleeve 103 may be configured to be positioned adjacent to a surface of magazine 102. The first layer may have a first coefficient of friction.

The second layer may be a vinyl layer including an image, wherein the second layer may be configured to be positioned on the first layer. In embodiments, the second layer may be configured to be heat pressed onto the first layer, such that the image on the second layer may be affixed to the first layer.

The third layer may be comprised of a second rubber material, such as neoprene, a fabric plastic composite, etc. The third layer may be comprised of a transparent rubber, wherein the third layer is configured to cover the first layer and the second layer. The third layer may be configured to receive force from a user, such that a user may couple and decouple sleeve 103 from firearm 100. The second layer may have a second coefficient of friction. In embodiments, the first rubber material may be different than the second rubber material, wherein the second rubber may be more malleable than the first rubber.

Figure 3:
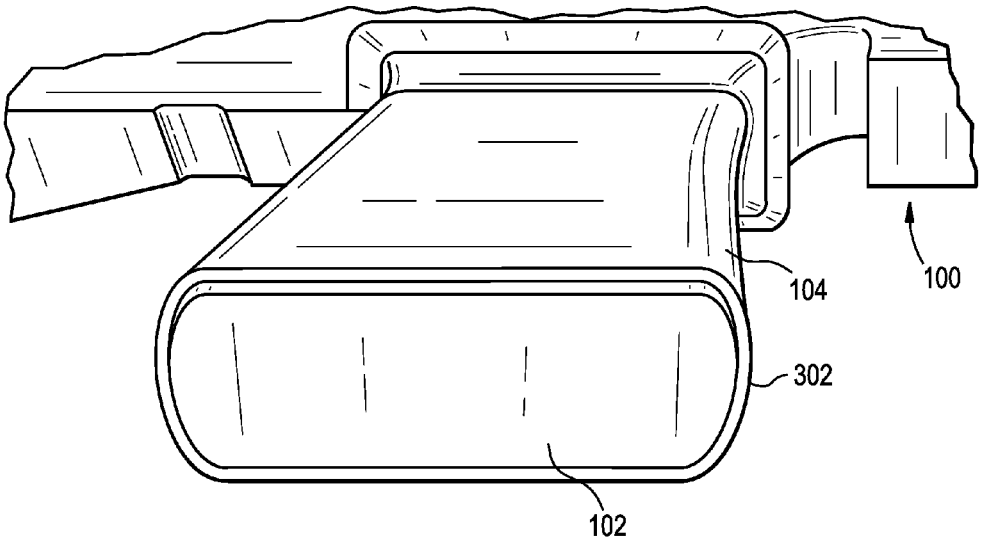
FIG. 3 depicts a bottom perspective view of a sleeve being positioned on a firearm, according to an embodiment.

FIG. 3 depicts one embodiment of sleeve 103 coupled with firearm 100. In embodiments sleeve 103 may be formed be coupling a first end of sleeve 103 with a second end of sleeve 103 via a seal and seam 302. Initially, first end of sleeve 103 and second of sleeve 103 may be sealed together via heat, epoxy, adhesives, etc. Once the adhesive has coupled the ends of sleeve 103, seam 302 may be created that extends across the entire width of sleeve 103. Seam 302 may be configured to reinforce the coupling of the first end of sleeve and the second end of sleeve 130. In embodiments, seam 302 may be created by sewing the ends of sleeve 103 together.

As further depicted in FIG. 3, the bottom surface of magazine 102 may not be covered by sleeve 103. Additionally, when magazine 102 is coupled with firearm 100, sleeve 103 may be configured to cover the second portion of magazine 102 extending away from a body of firearm 100 without covering the first portion of firearm 100 housed within firearm 100. Accordingly, sleeve 103 may not cover the top surface of magazine 102, which will allow projectiles to be removed from magazine 102 and positioned within firearm 100.

Figure 4:
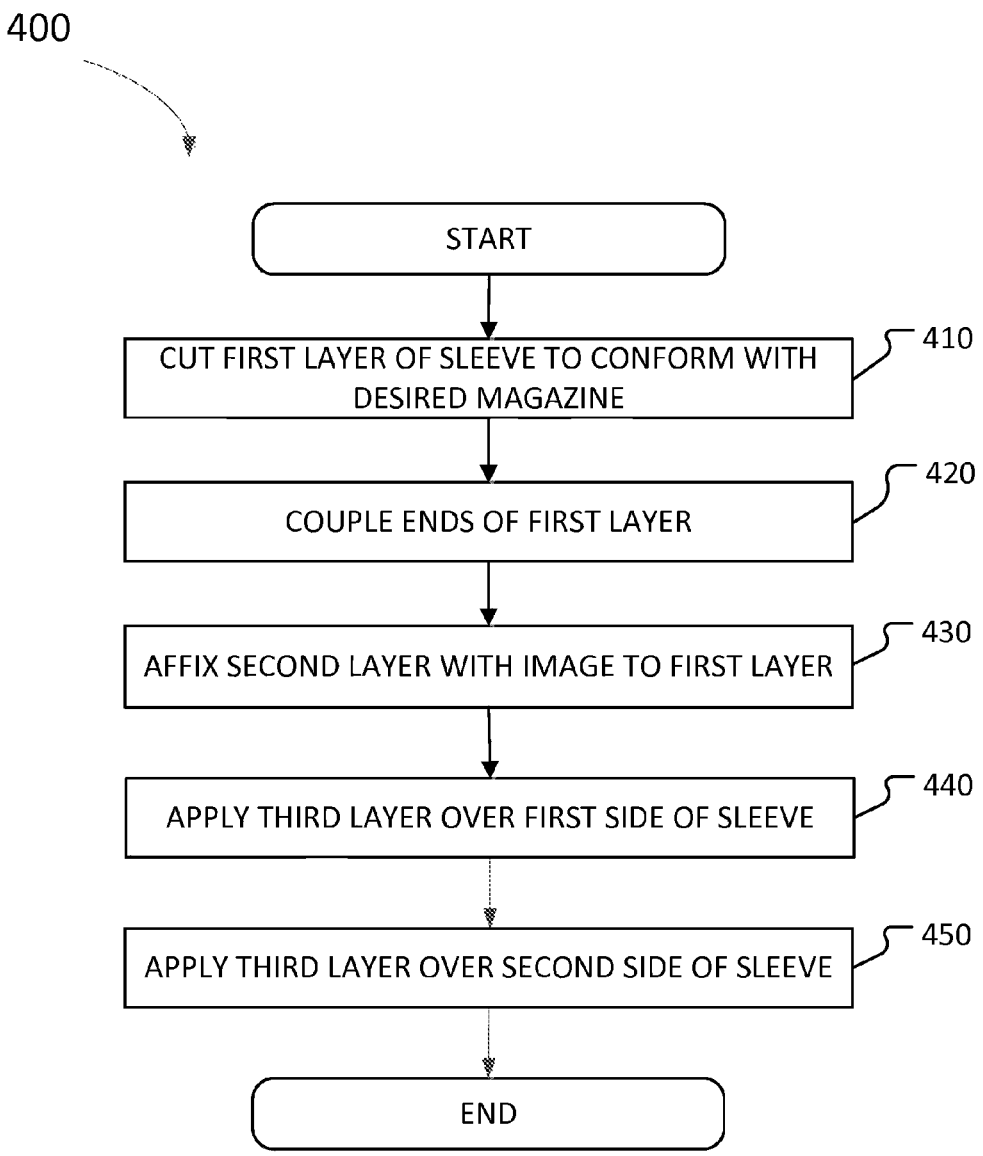
FIG. 4 depicts a method of manufacturing and using a sleeve, according to an embodiment.

FIG. 4 illustrates a method 400 for creating a sleeve for a firearm. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, a first layer of the sleeve may be cut, shaped, and/or sized to conform with a desired shape and/or size of a magazine for a firearm. In embodiments, the first layer may include a neoprene rubber that is laminated or adhered to a polyester fabric when it is made.

At operation 420, a first end and a second end of the first layer of the sleeve may be coupled together. The ends of the first layer may be coupled together by heat seal, adhesives, stitching, etc. In embodiments, the ends of the first layer may be fused together and sewn to reinforce the seem At operation 430, a second layer may be affixed to a first side of the first layer. The second layer may be affixed to the first side via heat pressing. The second layer may be utilized to customer the sleeve different logos, pictures, decals, etc. The customization of the sleeve may be creating by dye-sublimation printing. During the printing process, heat may be utilized to transfer dye onto the first layer of the sleeve. For example, a design may be affixed to the first layer via heat transfer vinyl. More specifically, any desired design may be printed and cut onto the second layer. Vinyl may be peeled from a paper backing of the second layer, and the design may be placed on the first layer. The design positioned on the first layer may be inserted onto a heat press, wherein the design may be applied via a heat press on the first side of the sleeve, then an image may be heat pressed onto the second side of the sleeve. Alternatively, another semi-permanent or permanent printing method may be utilized to customize the sleeve.

At operation 440, responsive to the designs being heat pressed onto both sides of the sleeve, the third layer may be applied to the first side of the sleeve. The third layer may initially be a semi-liquid material that requires sufficient amount of time to dry. In embodiments, the first side of the sleeve may be tapped off, so that the third layer, being comprised of a clear rubber in liquid form does not get applied to the entire sleeve. The third layer may be applied with a special touch up application. Responsive to a sufficient third layer is applied onto the first side of the sleeve, the tape is peeled off the sleeve, and the first side of the sleeve including the third layer may be set off to dry.

At operation 450, responsive to the third layer becoming bonded and dried on the first side of the sleeve, the third layer may be applied to a second side of the sleeve. The third layer may be applied to the second side of the sleeve in substantially the same manner as described above in operation 440.

In embodiments, the entire drying process of a sleeve may take around twelve hours. Upon the sleeve being dried, the sleeve may be packaged and shipped.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of a process.

What is claimed is:

1. A firearm sleeve comprising:

an internal surface comprised of neoprene rubber laminated onto a polyester fabric forming a first layer configured to be positioned adjacent to a magazine;

an external surface comprised of a transparent material forming a second layer configured to be griped by a user, the internal surface having a coefficient of friction to couple the firearm sleeve and the magazine, wherein the firearm sleeve is comprised of a flexible material, wherein the internal surface is comprised of a different material having different coefficient of friction that the external surface, wherein both of the different materials are malleable being different types of rubber, the second layer initially being a semi-liquid material;

a first opening positioned at a first end of the firearm sleeve;

a second opening positioned at a second end of the firearm sleeve, wherein the first layer and the second layer comprised of different material extend from the first opening to the second opening, wherein the internal surface and the external surface extend from the first opening to the second opening, wherein sidewalls of the firearm sleeve form a continuous surface having a uniform thickness from the first opening to the second opening, the second opening having an oval shape;

a firearm magazine having a longer length than a length between the first opening and the second opening, wherein an entire bottom surface of the firearm magazine is exposed via the second opening, wherein a size and shape of the first opening and the second opening are substantially the same;

a third layer comprised of a polyester fabric including an image, the third layer being configured to be laminated and heat pressed onto the polyester fabric of the first layer before the second layer is positioned over the third layer, the third layer being positioned between the first layer and the second layer;

a first end and a second end having planar sidewalls forming the length between the first opening and the second opening a linear seam extending from the first opening to the second opening configured to couple the first end and the second end by fusing together the first end and the second end, and sewing the first end and the second end together to reinforce the seam.

2. The firearm sleeve of claim 1, wherein the magazine includes a first portion and a second portion, wherein the first portion is configured to be housed within the firearm and the second portion is configured to extend away from the firearm.

3. The firearm sleeve of claim 2, wherein the firearm sleeve is configured to cover the second portion of the magazine.

4. The firearm sleeve of claim 1, wherein the magazine sleeve is comprised of a synthetic rubber having a thickness between one millimeter and two and half millimeters.

5. The firearm sleeve of claim 1, wherein the firearm sleeve is comprised of a material that is more flexible and pliant than the magazine.

6. The firearm sleeve of claim 1, wherein the user is configured to grip and hold the firearm sleeve to couple and decouple the magazine from the firearm.

* * * * *